US008161763B2

(12) United States Patent
Yun et al.

(10) Patent No.: US 8,161,763 B2
(45) Date of Patent: Apr. 24, 2012

(54) METHOD FOR CONTROLLING A COMPRESSOR AND A CONTROL VALVE OF A REFRIGERATOR

(75) Inventors: Young Hoon Yun, Seoul (KR); Hyoung Keun Lim, Seoul (KR); Gye Young Song, Seoul (KR)

(73) Assignee: LG Electronics Inc., Seoul (KR)

( * ) Notice: Subject to any disclaimer, the term of this patent is extended or adjusted under 35 U.S.C. 154(b) by 637 days.

(21) Appl. No.: 12/035,736

(22) Filed: Feb. 22, 2008

(65) Prior Publication Data

US 2009/0113904 A1 May 7, 2009

(30) Foreign Application Priority Data

Nov. 5, 2007 (KR) ..... 10-2007-0112131

(51) Int. Cl.
*F25B 5/00* (2006.01)

(52) U.S. Cl. ..... 62/200; 62/216; 62/217

(58) Field of Classification Search ..... 62/200, 62/216, 217, 228.5
See application file for complete search history.

(56) References Cited

U.S. PATENT DOCUMENTS

| | | | | |
|---|---|---|---|---|
| 3,460,352 | A | 8/1969 | Lorenz | |
| 3,626,979 | A * | 12/1971 | Abell | 137/528 |
| 4,369,631 | A | 1/1983 | Abraham | |
| 4,528,821 | A | 7/1985 | Tershak et al. | |
| 5,564,286 | A | 10/1996 | Suse | |
| 6,370,895 | B1 * | 4/2002 | Sakuma et al. | 62/199 |
| 6,397,608 | B1 * | 6/2002 | Sakuma et al. | 62/158 |
| 2002/0134095 | A1 * | 9/2002 | Temmyo et al. | 62/179 |
| 2004/0107727 | A1 * | 6/2004 | Kim et al. | 62/525 |
| 2005/0172665 | A1 * | 8/2005 | Kim et al. | 62/525 |
| 2006/0144063 | A1 | 7/2006 | Oh | 62/200 |
| 2007/0033962 | A1 * | 2/2007 | Kang et al. | 62/441 |
| 2007/0144190 | A1 * | 6/2007 | Temmyo et al. | 62/180 |
| 2007/0151289 | A1 * | 7/2007 | Youn et al. | 62/527 |
| 2007/0227166 | A1 * | 10/2007 | Rafalovich et al. | 62/199 |

FOREIGN PATENT DOCUMENTS

| | | | |
|---|---|---|---|
| EP | 2136166 | A1 * | 12/2009 |
| JP | 2002333254 | A * | 11/2002 |
| JP | 2006125843 | A * | 5/2006 |

OTHER PUBLICATIONS

JP2002333254A_Machine Translation.*
JP2006125843A_Machine Translation.*
U.S. Office Action U.S. Appl. No. 12/035,723 issued Jun. 29, 2010.
International PCT Search Report dated Oct. 23, 2008.
International PCT Search Report dated Mar. 16, 2010.

* cited by examiner

*Primary Examiner* — Cheryl J Tyler
*Assistant Examiner* — Paolo Gonzalez
(74) *Attorney, Agent, or Firm* — KED & Associates, LLP

(57) ABSTRACT

A refrigerator control method is disclosed which ensures efficient operation of a compressor. To control a refrigerator including a compressor, a first evaporator and a second evaporator connected to the compressor, and a refrigerant control valve that controls introduction of a refrigerant into the first evaporator and the second evaporator, the refrigerator control method includes operating the compressor, and controlling the opening and closing of the refrigerant control valve, to reduce not only consumption of electricity by the compressor, but also a pressure difference between an entrance and an exit of the compressor upon starting of the compressor.

12 Claims, 8 Drawing Sheets

METHOD FOR CONTROLLING A COMPRESSOR AND A CONTROL VALVE OF A REFRIGERATOR

This application claims priority to Korean Patent Application No. 10-2007-0112131, filed in Korea on Nov. 5, 2007, which is hereby incorporated by reference in its entirety.

BACKGROUND

1. Field

A method for controlling a refrigerator is disclosed herein.

2. Background

Refrigeration control methods are known. However, they suffer from various disadvantages.

BRIEF DESCRIPTION OF THE DRAWINGS

Embodiments will be described in detail with reference to the following drawings in which like reference numerals refer to like elements, and wherein.

DETAILED DESCRIPTION

Figure 1:
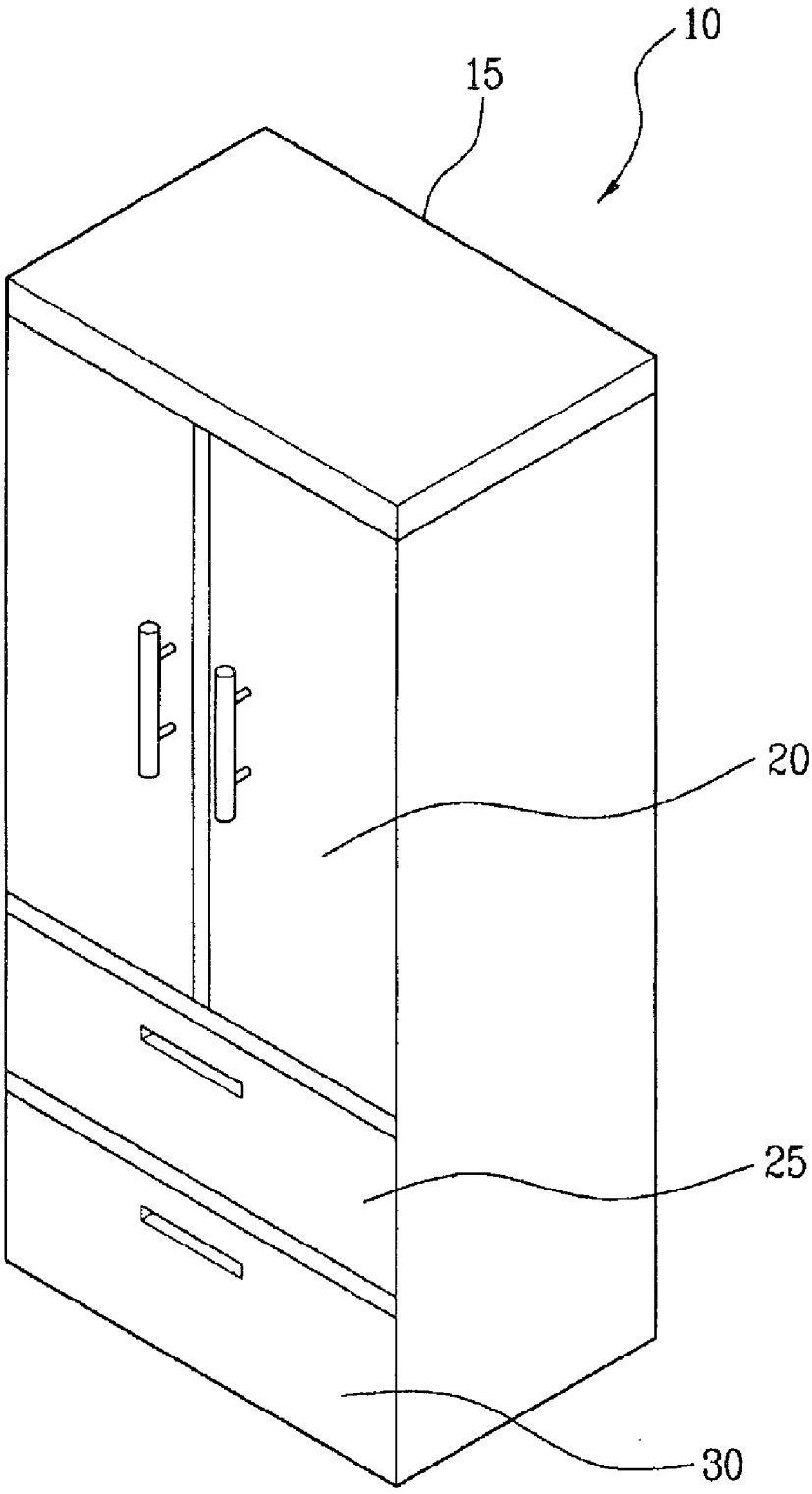
FIG. 1 is a front perspective view of a refrigerator according to an embodiment.

Reference will now be made in detail to a refrigerator control method according to embodiments disclosed herein, examples of which are illustrated in the accompanying drawings. In the drawings, like reference numerals have been used to refer to like elements.

Generally, a refrigerator includes a freezing compartment or storage room and a refrigerating compartment or storage room. The refrigerating storage room may be kept at a temperature of approximately ~3° C. to ~4° C., to keep food and vegetables fresh for a long time. The freezing storage room may be kept at a sub-zero temperature, to keep food, meat, and other items in a frozen state.

FIG. 1 is a front perspective view of a refrigerator according to an embodiment. The refrigerator 10 of FIG. 1 may include a main body 15, a refrigerating compartment or storage room 20, and a freezing compartment or storage room 30. The refrigerator 10 may further include a switching compartment or convertible storage room 25 which may provide a freezing or cooling function.

The refrigerator may further include an evaporator that supplies cold air into the refrigerating storage room and the freezing storage room selectively or simultaneously, in order to achieve a refrigerating operation for the refrigerating storage room or a freezing operation for the freezing storage room. Recently, refrigerators have been provided with two evaporators, namely, a refrigerating storage room evaporator to achieve a refrigerating operation for the refrigerating storage room and a freezing storage room evaporator to achieve a freezing operation for the freezing storage room.

To control the evaporators connected parallel to the compressor, a variable compressor has mainly been used. However, the use of a variable compressor increases the price of products.

Figure 2:
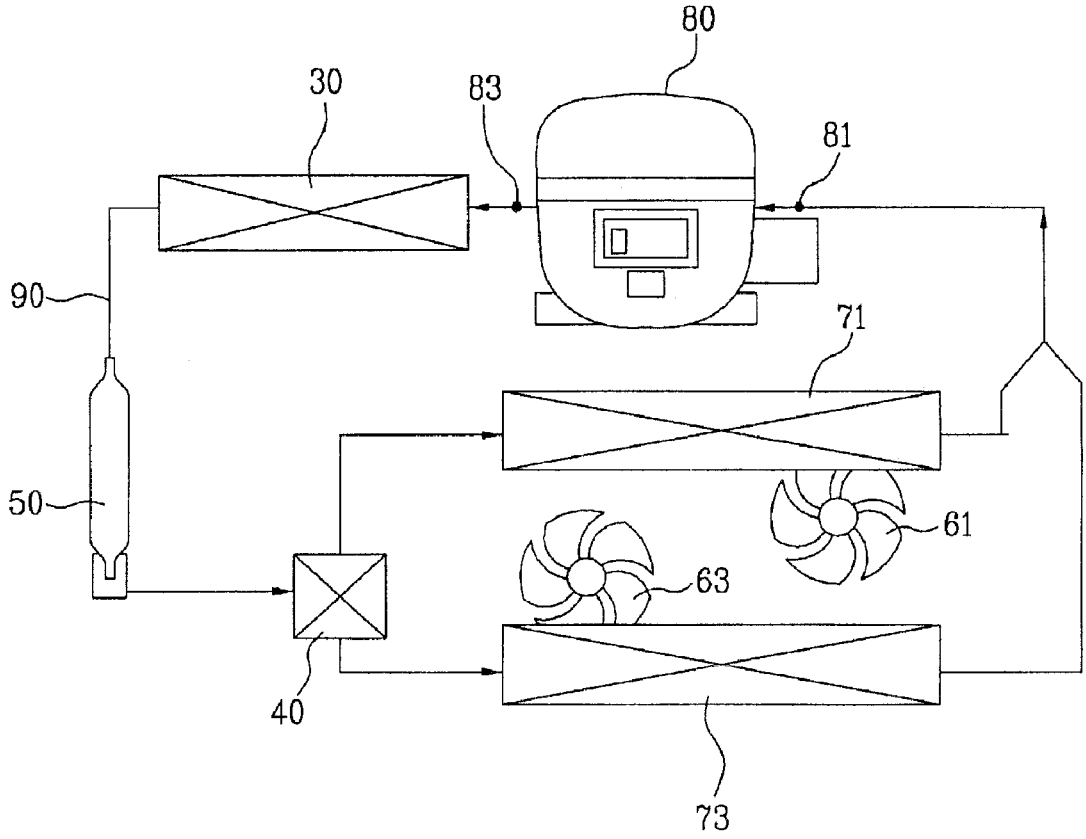
FIG. 2 is a schematic diagram illustrating a cycle of a refrigerator according to an embodiment.

First, a cycle of a refrigerator according to an embodiment will be described, with reference to FIG. 2. The refrigerator cycle may be implemented in a refrigerator such as that shown in FIG. 1.

The refrigerator may include a compressor 80, a condenser 30, a refrigerant tube 90, a refrigerant control valve 40, an expander 50, evaporators 71 and 73, and blowing fans 61 and 63. The compressor 80 may serve to compress a refrigerant, and the condenser 30 may serve to condense the compressed refrigerant. Also, the refrigerant tube 90 may serve as a flow path to guide flow of refrigerant within the refrigerator.

Refrigerant, having passed through the condenser 30, may be introduced into the refrigerant control valve 40 by way of the expander 50. The refrigerant control valve 40 may be installed on the refrigerant tube 90, and may serve to control the flow of the refrigerant, so as to allow a refrigerating operation for the refrigerating storage room and a freezing operation for the freezing storage room to be performed simultaneously or selectively. A three-way valve may be used as the refrigerant control valve 40.

In the above description, it should be appreciated that the refrigerant, having passed through the condenser 30, may be directly introduced into the refrigerant control valve 40, and into the expander 50 after passing through the refrigerant control valve 40.

The two evaporators 71 and 73 may include a first evaporator 71 that provides a refrigerating operation for the refrigerating storage room, and a second evaporator 73 that provides a freezing operation for the freezing storage room. A first blowing fan 61 may be provided at a side of the first evaporator 71, to ensure efficient heat exchange around the first evaporator 71, for example, heat exchange between the refrigerant and the surrounding air. A second blowing fan 63 may be provided at a side of the second evaporator 73, to facilitate heat exchange around the second evaporator 73. The refrigerant may be guided into the first evaporator 71 and the second evaporator 73 simultaneously or selectively, to cool the refrigerating storage room and/or the freezing storage room.

Figure 3A:
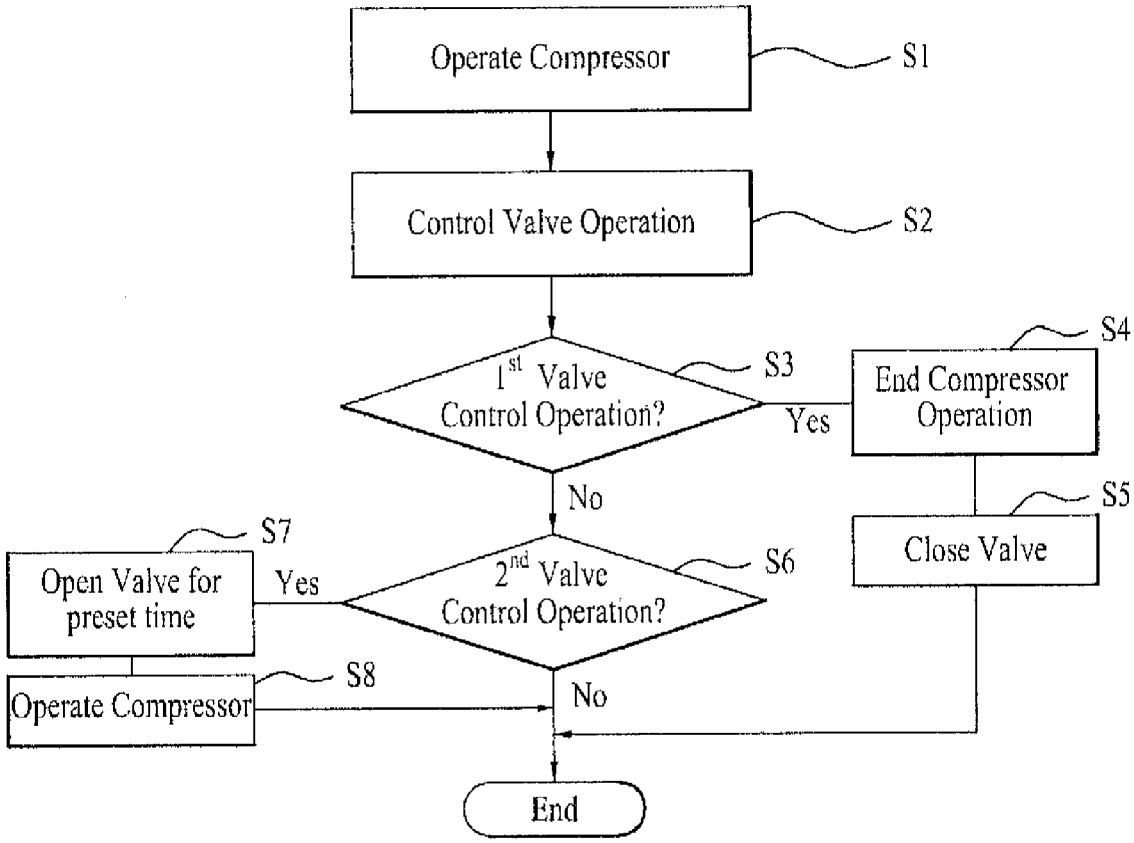
FIGS. 3A-3C illustrate a refrigerator control method according to an embodiment

Hereinafter, a refrigerator control method according to an embodiment will be described with reference to FIGS. 3 to 5. The refrigerator control method according to this embodiment may include a compressor operating step (S1) and a valve control step (S2) controlling the opening and closing of the refrigerant control valve 40, in order to reduce consumption of electricity by the compressor and to reduce a pressure difference between an entrance 81 and an exit 83 of the compressor 80 upon starting of the compressor 80.

The valve control step (S2) may include a first valve control operation (S3-S5) including controlling the opening and closing of the refrigerant control valve 40 just after ending operation of the compressor 80, and a second valve control operation (S6-S8) including controlling the opening and closing of the refrigerant control valve 40 just prior to beginning operation of the compressor 80.

In the first valve control operation, the refrigerant control valve may be closed (S5), to prevent the refrigerant from being introduced into the first and second evaporators 71, 72 just after ending the operation of the compressor 80 (S4), thereby preventing heat exchange between the first evaporator 71 and the second evaporator 72. This may reduce loss of heat during the operation of the refrigerator, and consequently, reduce consumption of electricity.

In the second valve control operation, the refrigerant control valve 40 may be opened for a preset period of time (S7) prior to beginning the operation of the suspended compressor 80 (S8), thereby reducing a pressure difference between a suction side 81 and a discharge side 83 of the compressor 80. This may reduce a starting torque of the compressor 80 upon operation of the compressor 80.

Figure 3B:
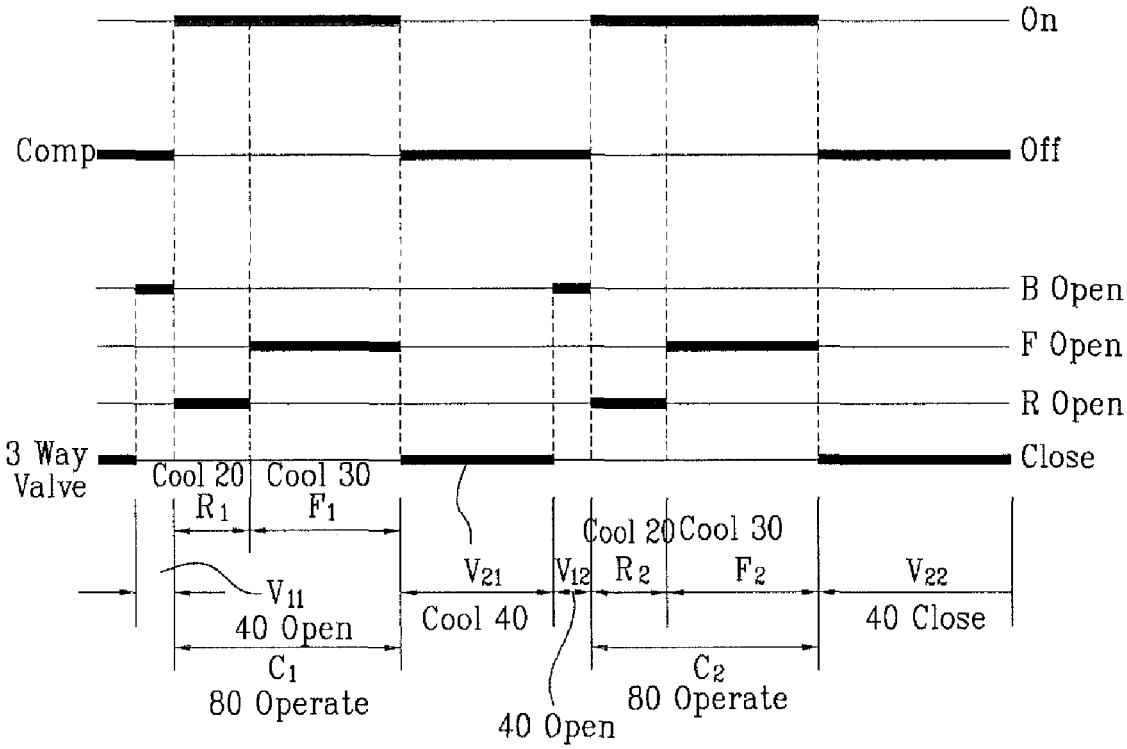
Figure 3C:
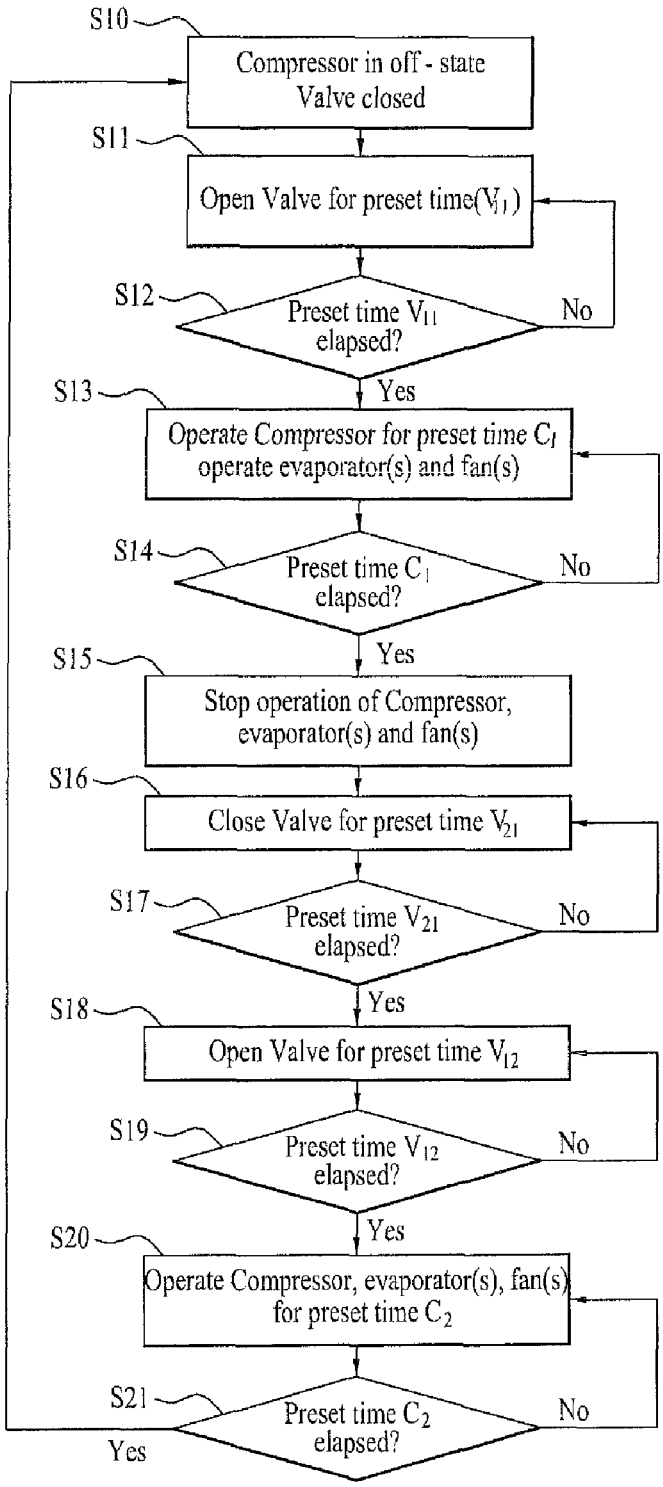

FIG. 3B is a table illustrating operation and suspension of the first and second evaporators and the opening and closing of the refrigerant control valve, on the basis of the operating sequence of the compressor. Referring to FIGS. 3B and 3C, after ending the operation of the compressor 80, the refrigerant control valve 40 may be closed, to prevent the refrigerant from being introduced into the first evaporator 71 and the second evaporator 73 S10. Then, the suspended state of the compressor 80 may be continued for a preset period of time.

Prior to beginning the operation of the suspended compressor 80, the refrigerant control valve 40 may be opened for a preset opening time ($V_{11}$) (S11-S12). Then, the compressor may begin to operate ($C_1$) (S13-S14). During operation of the compressor 80, the operation of the first evaporator 71, for example, the refrigerating operation for the refrigerating storage room, and the operation of the second evaporator 43, for example, the freezing operation for the freezing storage room may be performed alternately ($R_1$ and $F_1$) (S13).

Simultaneously with ending the operation of the compressor 80, the refrigerating operation for the refrigerating storage room, and the freezing operation for the freezing storage room may be ended simultaneously (S15). At this time, the refrigerant control valve 40 may be in a closed state ($V_{21}$) (S16-S17).

In the above description, it is noted that the suspension time of the compressor 80 and the closing time of the refrigerant control valve 40 may be set differently from each other. More specifically, the closing time of the refrigerant control valve 40 may be shorter than the suspension time of the compressor 80 because the refrigerant control valve 40 may be opened for a while prior to beginning the operation of the compressor 80.

Subsequently, the refrigerant control valve 40 may be, opened for a preset opening time prior to beginning the operation of the compressor 80 ($V_{12}$) (S18-S20). Thereafter, similar to the above described sequence, the compressor 80 may begin operate ($C_2$), and during the operation of the compressor 80, the refrigerating operation for the refrigerating storage room and the freezing operation for the freezing storage room may be performed ($R_2$ and $F_2$) (S20-S21).

In the above description, it should be appreciated that the refrigerating storage room and the freezing storage room may be operated simultaneously. In this case, the refrigerant, having passed through the refrigerant control valve 40, may be introduced into the first evaporator 71 and the second evaporator 72 simultaneously.

In the embodiments disclosed herein, the compressor may be a constant-speed compressor. Examples of such a constant-speed compressor may include a reciprocating compressor, a linear compressor, or similar device. When using the constant-speed compressor, there is no need for a refrigerant recovery operation between the first evaporator 71 and the second evaporator 72 connected parallel to the constant-speed compressor. Consequently, it is unnecessary to provide piping, connected to the second evaporator 72 for the freezing operation, with a check valve used to prevent backflow of the refrigerant.

The refrigerant control valve 40 may be repeatedly opened at predetermined time intervals. Also, the opening time of the refrigerant control valve may be set to a range of ~3 minutes to ~7 minutes. This will be described hereinafter in detail with reference to FIG. 6.

Now, the results of the refrigerator control method according to embodiments disclosed herein will be described with reference to FIGS. 4 to 6.

Figure 4:
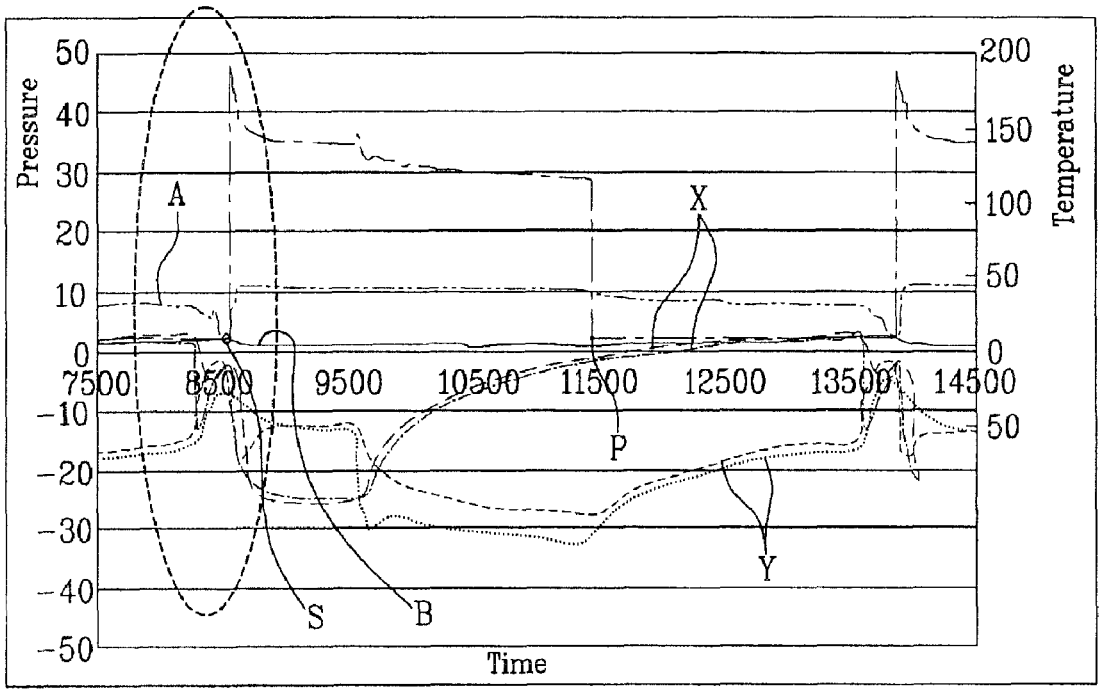
FIG. 4 is a graph illustrating variation of pressure at an entrance and an exit of a compressor according to a lapse of an operating time.

FIG. 4 is a graph illustrating variation of pressure and variation of temperature at the entrance and the exit of the compressor according to the lapse of time during the operation of the refrigerator. FIG. 5 illustrates consumption of electricity as well as variation of pressure at the entrance and the exit of the compressor according to the lapse of time during the operation of the refrigerator.

As can be appreciated from FIG. 4, if the refrigerant control valve is opened for a predetermined period of time prior to operating the compressor, the entrance and the exit of the compressor have a pressure B and a pressure A, respectively, which are in equilibrium at a time point S when the compressor begins to operate. In this case, the pressure may be approximately 2 $kgf/cm^2$, and the compressor kept at a temperature of around 10° C. As a result, the compressor may sufficiently satisfy a required starting torque even at the time point S when the compressor begins to be operated.

If the refrigerant control valve is closed at a time point P just after ending the operation of the compressor, there is no heat exchange between the first evaporator and the second evaporator. Thus, there is a temperature difference between a temperature X of the entrance/exit of the first evaporator 41 and a temperature Y of the entrance/exit of the second evaporator 72, and this temperature difference is maintained for a predetermined period of time.

Figure 5:
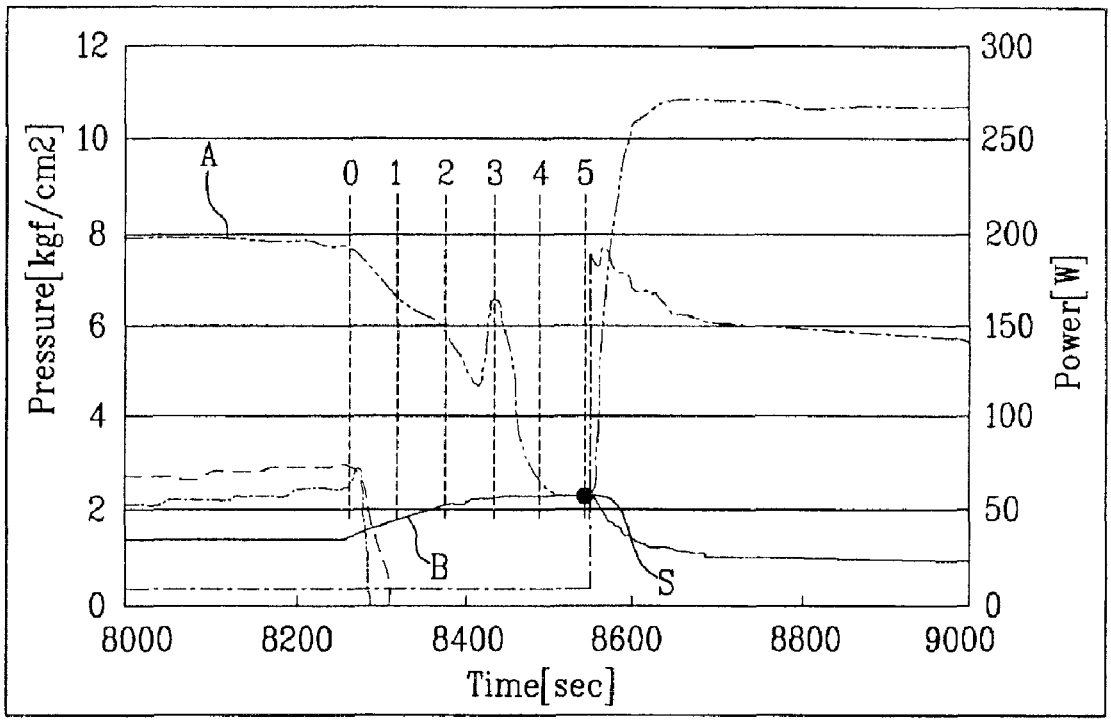
FIG. 5 is an enlarged view of a part of the graph shown in FIG. 3, illustrating the pressure of the compressor just prior to beginning the operation of the compressor.

FIG. 5 illustrates in detail variation of pressure B at the entrance of the compressor and variation of pressure A at the exit of the compressor, at ~1 minute intervals, in a state in which the opening time of the refrigerant control valve prior to operating the compressor is set to ~5 minutes.

If the starting torque of the compressor can be accurately calculated, the opening time of the refrigerant control valve may be reduced. The shorter the opening time of the refrigerant control valve, the lesser the exchange rate of heat between the first evaporator 41 and the second evaporator 72. Therefore, the thermal efficiency of each evaporator increases, and consequently, the consumption of electricity may be reduced.

In conclusion, it should be appreciated from the above described embodiment that, when the refrigerant control valve is closed just after ending the operation of the compressor, but is opened for a predetermined period of time prior to beginning the operation of the compressor, the consumption efficiency of electricity may be improved by approximately 9% as compared to a case in which the refrigerant control valve is opened after ending the operation of the compressor.

Figure 6:
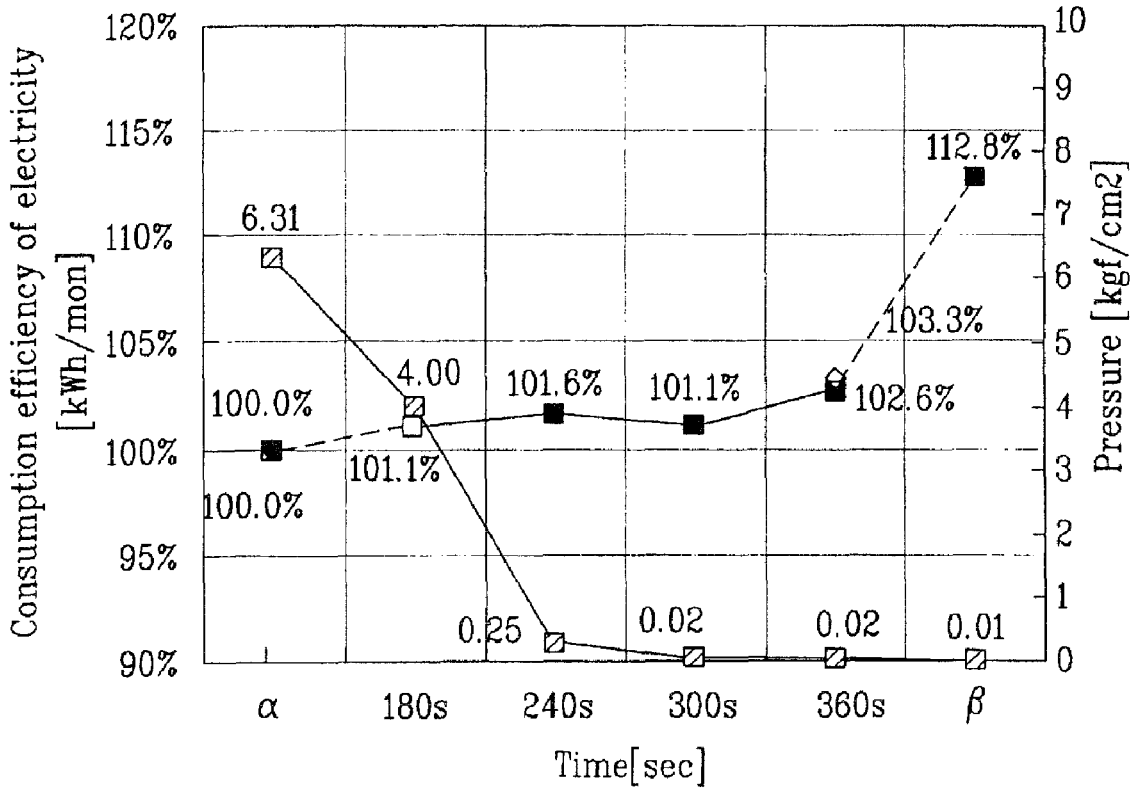
FIG. 6 is a graph illustrating a pressure difference between a suction side and a discharge side of the compressor and consumption of electricity according to the refrigerator control method, on the basis of FIG. 5.

FIG. 6 is a graph illustrating a pressure difference between a suction side and a discharge side of the compressor and consumption of electricity. As shown, in the case where the refrigerant control valve is closed after ending the operation of the compressor ($\alpha$), the highest consumption efficiency of electricity may be accomplished. This is because there is no heat exchange between the first evaporator 71 and the second evaporator 72, and thus, superior thermal efficiency of the evaporators and the lowest consumption of electricity may be accomplished. On the other hand, upon starting of the compressor, the suction side and the discharge side of the compressor have the largest pressure difference (approximately 6 atmospheres).

Meanwhile, when the refrigerant control valve is opened for approximately 240 seconds prior to beginning the operation of the compressor, the consumption efficiency of the electricity may be lowered by ~1% as compared to a case in which the refrigerating control valve is closed prior to beginning the operation of the compressor. However, upon starting of the compressor, the pressure difference between the suction side and the discharge side of the compressor may be lowered to the level of ~0.25 atmospheres, and this has the advantage of eliminating a limit in the starting torque of the compressor.

Also, in the case where the refrigerant control valve is completely opened after ending the operation of the compressor (β), the consumption efficiency of the electricity may be lowered by ~12.8% as compared to the case in which the refrigerant control valve is completely closed after ending the operation of the compressor. On the other hand, upon starting of the compressor, there is substantially no pressure difference between the suction side and the discharge side of the compressor.

With reference to the above description, the opening time of the refrigerant control valve prior to operating the compressor may be set in a range of ~180 seconds to ~420 seconds, in view of the consumption of electricity and the starting torque of the compressor. More particularly, in consideration of the graph illustrated in FIG. 6, the opening time of the refrigerant control valve may be set to ~300 seconds.

Embodiments disclosed herein provide a refrigerator control method that may reduce the price of products. Further, embodiments disclosed herein provide a refrigerator control method that may reduce consumption of electricity and eliminate a limit in a starting torque of a compressor.

Embodiments disclosed herein provide a control method for a refrigerator that includes a compressor, a first evaporator and a second evaporator connected to the compressor, and a refrigerant control valve to control a refrigerant to be introduced into the first evaporator and the second evaporator. The refrigerator control method may include operating the compressor, and controlling opening and closing of the refrigerant control valve, to reduce not only consumption of electricity by the compressor, but also a pressure difference between an entrance and an exit of the compressor upon starting of the compressor. The control of the refrigerant control valve may further include a first valve control operation that includes controlling the opening and closing of the refrigerant control valve just after ending the operation of the compressor, and a second valve control operation that includes controlling the opening and closing of the refrigerant control valve just prior to beginning the operation of the compressor.

In the first valve control operation, the refrigerant control valve may be closed, to prevent the refrigerant from being introduced into the first and second evaporators after ending the operation of the compressor. In the second valve control operation, the refrigerant control valve may be opened for a predetermined time prior to beginning the operation of the compressor.

Further, the compressor may be a constant-speed compressor. The refrigerant control valve may supply the refrigerant into the first evaporator and the second evaporator simultaneously or selectively. Also, a suspension time of the compressor may differ from a closing time of the refrigerant control valve. An opening time of the refrigerant control valve may be in a range of ~3 minutes to ~7 minutes. The refrigerant control valve may be repeatedly opened at predetermined time intervals.

A refrigerator control method according to embodiments disclosed herein has at least the following advantages.

First, by opening a refrigerant control valve for a preset time prior to beginning the operation of a compressor, it is possible to reduce a pressure difference between the entrance and the exit of the compressor. This provides the advantage of eliminating a limit in a starting torque of the compressor. In particular, when the refrigerant control valve is closed just after ending the operation of the compressor, there is no heat exchange between a first evaporator and a second evaporator. This may reduce consumption of electricity.

Second, a refrigerator according to embodiments disclosed herein may include a constant-speed compressor, and first and second evaporators connected parallel to the constant-speed compressor. This may reduce the price of products.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A method of controlling a refrigerator for repeatedly performing a refrigerating operation and a freezing operation simultaneously or alternately in a refrigerating/freezing cycle, comprising:

operating a constant speed compressor; and controlling an opening and a closing of a refrigerant control three-way valve to control heat exchange at a plurality of evaporators connected in parallel for refrigerating and freezing chambers, respectively, thereby reducing not only consumption of electricity by the compressor, but also reducing a pressure difference between an entrance of the compressor and an exit of the compressor upon starting of the compressor, wherein controlling the opening and the closing of the refrigerant control three-way valve comprises:

controlling the refrigerant control three-way valve to be closed for a preset period of time during a portion of the refrigerating/freezing cycle for both the refrigerating chamber and the freezing chamber immediately after ending operation of the compressor in the refrigerating/freezing cycle to prevent refrigerant from being introduced into the plurality of evaporators after ending operation of the compressor; and after the preset period of time in which the refrigerant control three-way valve is closed during the portion of the refrigerating/freezing cycle, controlling the refrigerant control three-way valve to be opened for both the refrigerating chamber and the freezing chamber for a predetermined period of time before beginning operation of the compressor in a next refrigerating/freezing cycle, wherein the predetermined period of time of the refrigerant control three-way valve is in a range of approximately 3 minutes to 7 minutes.

2. The control method according to claim 1, wherein the compressor is a reciprocating compressor.

3. The control method according to claim 1, wherein the refrigerant control three-way valve controls an amount of refrigerant introduced into the plurality of evaporators connected to the compressor.

4. The control method according to claim 1, wherein the refrigerant control three-way valve supplies the refrigerant into the plurality of evaporators simultaneously or selectively.

5. The control method according to claim 1, wherein the predetermined period of time of the refrigerant control three-way valve is determined by an initial driving torque of the compressor.

6. The control method according to claim 1, further comprising repeatedly opening the refrigerant control three-way valve at predetermined time intervals.

7. A method of controlling a refrigerator for repeatedly performing a refrigerating operation and a freezing operation simultaneously or alternately in a refrigerating/freezing cycle, comprising:

stopping operation of a constant speed compressor after operating the compressor for a predetermined period of time; and controlling a refrigerant control three-way valve to control an amount of refrigerant introduced into a plurality of evaporators connected in parallel to the compressor for refrigerating and freezing chambers of the refrigerator, wherein an operation ending time of the compressor is different from a closing time of the refrigerant control three-way valve, wherein the refrigerant control three-way valve is closed for a preset period of time during the refrigerating/freezing cycle for both the refrigerating and freezing chambers immediately after ending operation of the compressor to prevent refrigerant from being introduced into the plurality of evaporators during the refrigerating/freezing cycle, and the refrigerant control three-way valve is opened after the preset period of time during the refrigerating/freezing cycle for both the refrigerating and freezing chambers for a predetermined period of time before beginning operation of the compressor in a next refrigerating/freezing cycle, wherein the predetermined period of time of the refrigerant control three-way valve is in a range of approximately 3 minutes to 7 minutes.

8. The method according to claim 7, wherein the compressor includes a reciprocating compressor.

9. The method according to claim 7, wherein the refrigerant control three-way valve simultaneously supplies the refrigerant into the plurality of evaporators.

10. The method according to claim 7, wherein the refrigerant control three-way valve selectively supplies the refrigerant into the plurality of evaporators.

11. The method according to claim 7, wherein the predetermined period of time of the refrigerant control three-way valve is determined based on an initial driving torque of the compressor.

12. The method according to claim 7, further comprising repeatedly opening the refrigerant control three-way valve at predetermined time intervals.

* * * * *